United States Patent [19]

Watarai et al.

[11] Patent Number: 4,986,528

[45] Date of Patent: Jan. 22, 1991

[54] METHOD OF SEPARATELY FEEDING A PRINT MEDIUM SHEET AND APPARATUS THEREFOR

[75] Inventors: Shinichi Watarai, Yokohama; Yoji Houki, Tokyo; Tomohiro Nonomura, Takasago, all of Japan

[73] Assignee: Fujitsu Limited, Kawasaki, Japan

[21] Appl. No.: 360,698

[22] Filed: Jun. 2, 1989

[30] Foreign Application Priority Data

Jun. 7, 1988 [JP] Japan ..... 63-140133

[51] Int. Cl.[5] ..... G03G 15/00

[52] U.S. Cl. ..... 271/265; 271/266; 271/188; 271/159; 400/579; 400/636

[58] Field of Search ..... 271/242, 266, 270, 188, 271/158, 159, 265; 400/579, 630, 636

[56] References Cited

U.S. PATENT DOCUMENTS

| | | | |
|---|---|---|---|
| 4,030,723 | 6/1977 | Irvine et al. | 271/259 X |
| 4,525,788 | 6/1985 | Gottlieb et al. | 271/259 X |
| 4,548,394 | 10/1985 | Koyama | 271/9 |
| 4,621,802 | 11/1986 | Ishida | 271/272 |

FOREIGN PATENT DOCUMENTS

| | | |
|---|---|---|
| 2264824 | 3/1975 | Fed. Rep. of Germany . |
| 3538441 | 4/1986 | Fed. Rep. of Germany . |
| 62-17763 | 1/1987 | Japan . |
| 62-259944 | 11/1987 | Japan . |

*Primary Examiner*—Andres Kashnikow
*Assistant Examiner*—Kenneth DeRosa
*Attorney, Agent, or Firm*—Armstrong, Nikaido, Marmelstein, Kubovcik & Murray

[57] ABSTRACT

A skew of a print medium sheet generally occurs when the sheet is fed to an image-forming area in an image-forming apparatus, for example, an electronics image-forming printer, from a pile of such sheets. An apparatus according to the present invention is provided with a plurality of pairs of feed rollers between the pile and the image-forming area, and a skew of a sheet is corrected every time the sheet comes in contact with each pair of rollers which are not rotating for a predetermined time, so that even a large skew can be corrected by the time the sheet reaches the image-forming area.

7 Claims, 7 Drawing Sheets

METHOD OF SEPARATELY FEEDING A PRINT MEDIUM SHEET AND APPARATUS THEREFOR

BACKGROUND OF THE INVENTION

1. Field of the Invention

The present invention relates to a method of separately feeding a print medium sheet, for example, a paper sheet, from a pile of such separate print medium sheets, to an image-forming area in an image-forming apparatus such as a printer, a duplicator, and to an apparatus for carrying out this method.

2. Description of the Related Art

When paper sheets are separately fed from a cassette box, containing such paper sheets, to an image-forming area to form an image on the paper sheet, each sheet is in contact with a pair of stopping feed rollers and an advance of the sheet is stopped, and at this stage a skew of the sheet is corrected before the pair of feed rollers are rotated by a signal for starting to form an image on the sheet. Namely, as shown in FIG. 7, when a paper sheet P is fed by a pair of feed rollers 28*a*, 28*b* while another pair of feed rollers 30, 47, are stopped, the paper sheet P is brought into contact with the feed rollers 30, 47 which are not rotating and is rotated in the direction of the arrow al, and thus a skew thereof is corrected.

In the above-mentioned method, however, a space between two pairs of feed rollers must be large, to allow the skew of the paper sheet P to be corrected in that space, and thus the size of the image-forming apparatus must be relatively large, to enable a proper correction of a large skew of the sheet. Furthermore, when using multistage cassette boxes, the control method of separately feeding the sheets must be complex because a length of a path for feeding a sheet from each cassette box to the pair of feed rollers which are not rotating differs from each other so that the amount of scatter of each excess feed amount for the correction of the skew of the sheet determined by a calculation owing to a slip of the sheet in actual feed of the sheet becomes large.

SUMMARY OF THE INVENTION

Therefore, an object of the present invention is to eliminate the above drawbacks of the prior art and to provide a method of separately feeding paper sheets while correcting a skew thereof in a small space, and an apparatus for carrying out this method.

Another object of the present invention is to provide a simple mechanism for separately feeding a paper sheet and correcting a skew thereof.

Therefore, according to the present invention, there is provided a method of separately feeding a print medium sheet from a pile of print medium sheets to an image-forming area, for forming an image on the separate sheet, characterized in that at least two pairs of feed rollers are provided in a path of the sheet between the pile and the image-forming area, that a sheet is separately fed by a pick-up roller for picking up a sheet from the pile, to a pair of feed rollers which are not rotating, and after a predetermined time has passed while the separate sheet is in contact with the pair of feed rollers, the pair of feed rollers start to rotate to feed the sheet to the next pair of feed rollers which are not rotating, and after a predetermined time has passed while the sheet is in contact with the above-mentioned next pair of feed rollers, the next pair of feed rollers start to rotate to feed the sheet.

Furthermore, the present invention provides an apparatus for separately feeding a print medium sheet, the apparatus having a pick-up roller for picking up a print medium sheet from a pile of print medium sheets, and comprising a plurality of pairs of feed rollers disposed at predetermined positions along a path through which the sheets ar fed from the pile to an image-forming area for forming an image thereon, and a control means for controlling each pair of feed rollers of the plurality of pairs of feed rollers to hold stationary each pair of feed rollers for a predetermined time longer than a time during which the sheets travel to each pair of feed rollers from the pile.

According to the present invention, a skew of a sheet is corrected every time the sheet is in contact with each pair of feed rollers which are not rotated, because a pair of feed rollers at a rear position of the sheet are rotated to feed the sheet. Therefore, eventhough the skew of the sheet is large when the sheet is picked up, it is properly corrected. Furthermore, a dimension of an area for modifying the skew, especially a height dimension thereof may be small and a compact apparatus can be provided because the modification of the skew is effected several times.

BRIEF DESCRIPTION OF THE DRAWINGS

The other objects and advantages of the present invention will be more apparent from the following description with reference to the drawings illustrating the preferred embodiments of the present invention, wherein.

DESCRIPTION OF THE PREFERRED EMBODIMENTS

Figure 2:
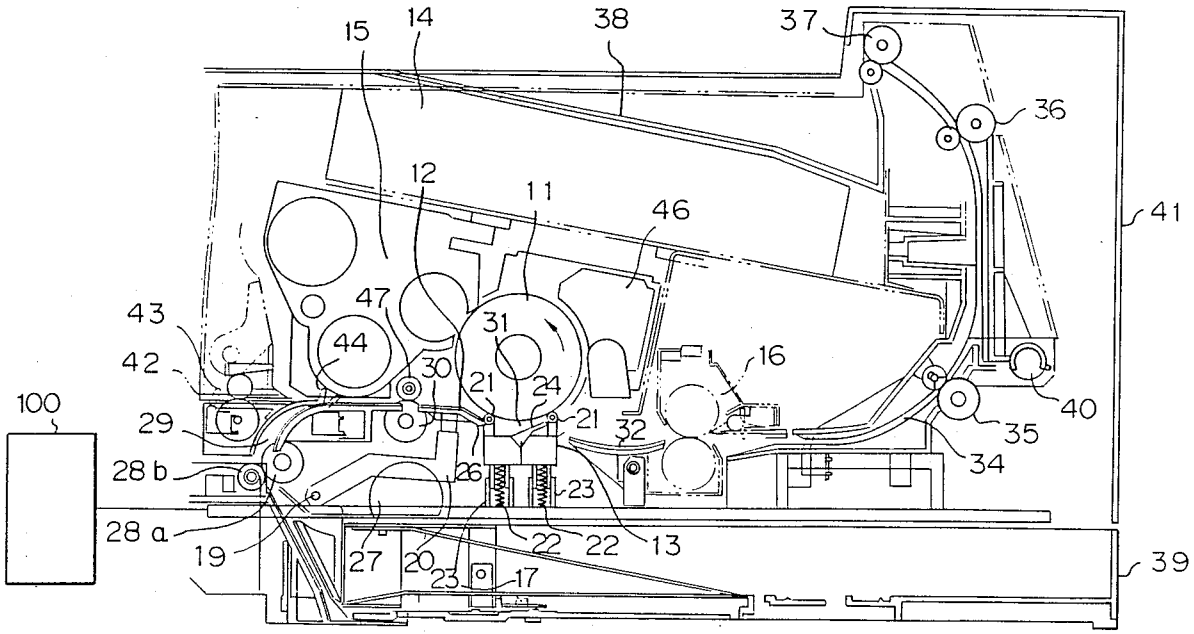
FIG. 2 is a cross sectional view of an electronics image-forming apparatus according to the present invention.
Figure 3:
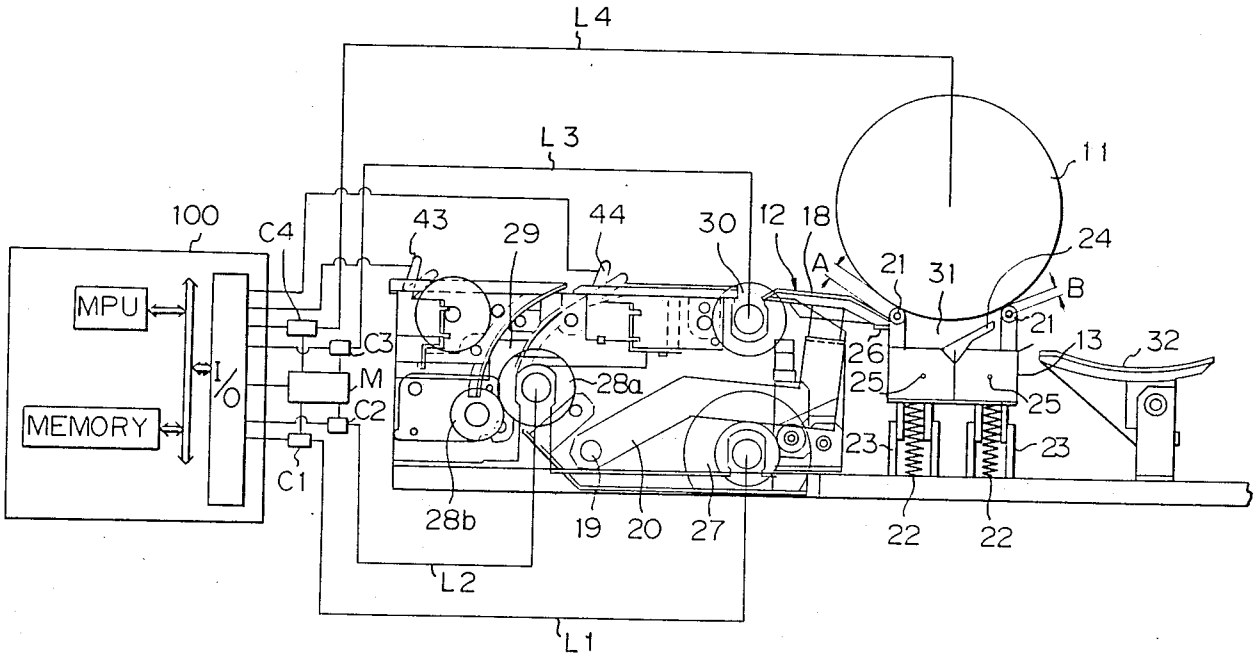
FIG. 3 is an enlarged partial cross sectional view of FIG. 2.
Figure 4:
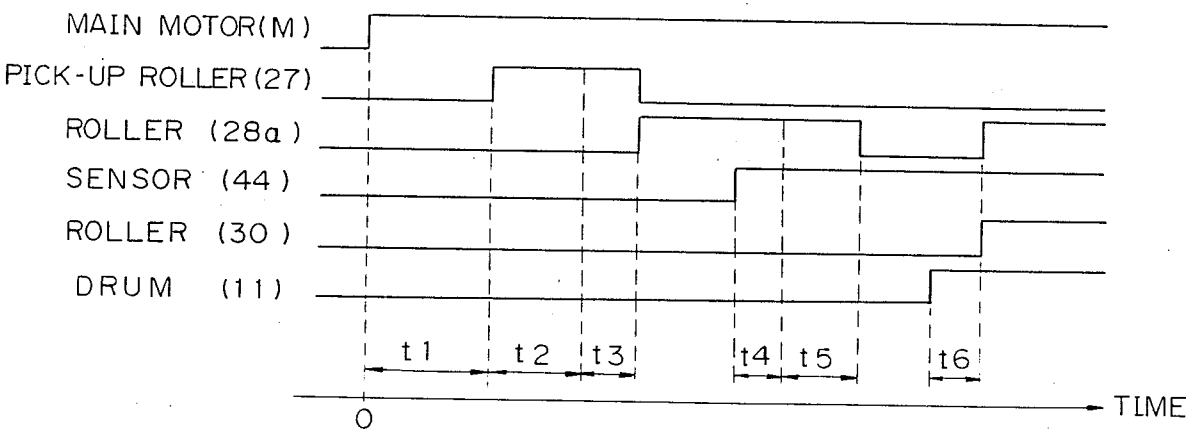
FIG. 4 is a time chart for explaining an operation of the embodiment of the present invention.

Referring to FIGS. 2 and 3, reference numerals 11, 12, 13, 14, 15, 16, and 17 designate a photoconductive drum, a guide for a print medium sheet, for example, a paper sheet, a transfer charger, a latent-image-forming unit for forming a latent image on the drum 11, a developer unit, a fuser unit, and a cassette box for housing paper sheets, respectively. The guide 12 is supported by an arm 20 supported by a supporting rod 19. The transfer charger 13 is mounted so as to be able to move in an upper or lower direction relative to the photoconductive drum 11, and is provided with two pairs of rollers 21 able to come into contact with a zone of the drum 11 on which image is not formed. The transfer charger 13 is pressed against the drum 11 by coil springs 22 so that the rollers 21 are in contact with the no-image forming zone to be positioned in such that an image can be formed, as shown in FIGS. 2 and 3. Guide members 23 guide the transfer charger 13 in the upper or lower direction such that a guide 24 for a paper sheet, provided to the transfer charger 13, is separated by an adequate gap having a dimension B from the drum 11, and corotron wires 25 are positioned as usual.

One end of the above-mentioned guide 12 is engaged with a projecting portion 26 of the transfer charger 13, under its own weight, to be linked to the transfer charger 13 in motion. Consequently, a gap having a dimension A between the guide 12 and the drum 11 is set to a usual value when the transfer charger 13 is positioned as shown in FIGS. 2 and 3. Namely the guide 12 for guiding a paper sheet into contact with the drum 11 must be mounted very close to the drum 11, to prevent the forming of an unclear image on the paper sheet and to maintain of the sheet correctly at the position where the image is formed. The gap dimensions B, A are automatically set to usual values, respectively, by the force of the springs 22, and even if the drum 11 is deformed and is deviated from a circle, the dimensions B, A can be kept in the usual values.

The image forming by the above-mentioned electronics image-forming apparatus is effected as follows.

A latent image corresponding to an image to be formed is formed on a surface of the drum 11 by the latent-image-forming unit 14, after the surface of the drum 11 is uniformly electrified by a pre-charging unit (not shown) while the drum 11 is rotated in a counter-clockwise direction as shown in FIG. 2, and the latent image is developed by the developer unit 15 to form a sensible image, i.e., a toner image.

A paper sheet housed in a known cassette box 17 is fed by a pick-up roller 27, for example, synchronously with a rotation of the drum 11. The sheet is fed to an image-forming area 31 at which the drum 11 and the transfer charger 13 are opposed to each other, and is guided by the guide 12 to pass through the gap A, after fed by feed rollers **28*a*, 28*b*, another feed roller 30, and a pinch roller 47 along a feed path 29. In the image-forming area 31, the toner image on the surface of the drum 11 is transferred to the paper sheet by the transfer charger 13**.

After the toner image is transferred to the sheet, the sheet is fed to the fixing unit 16 through the gap B, while being guided by a guide 32, and the toner image is fixed on the sheet. The sheet is fed correctly because the gap dimensions A and B are set to usual values as mentioned above, and thus a clear image is formed on the sheet.

The sheet on which the image is fixed is discharged to a tray 38 by way of a guide 34 and feed rollers 35, 36, 37. The surface of the drum 11 is cleaned by a cleaner 46 after the toner image thereon has been transferred to the sheet.

The guide 34, the feed roller 35, and other elements, except for the drum 11 of the elements shown in FIG. 3, are mounted on an lower frame 39, and the remaining elements among the elements shown in FIG. 2, are mounted on an upper frame 41 openably supported by a pin member 40 attached to the lower frame 39. Reference numeral 42 designates an insertion port for manually inserting a paper sheet, and reference numerals 43, 44 designate sensors for detecting a passing of a paper sheet.

A control for feeding a paper sheet is effected by a controller 100 shown in FIG. 3. A main motor M drives the pick-up roller 27, feed rollers **28*a*, 30, and the photoconductive drum 11 by way of clutches C1, C2, C3, and C4, respectively. These clutches C1–C4 and the motor M are electrically connected to the controller 100 to be controlled thereby. The sensors 43 and 44 are also connected to the controller 100. The controller 100 consists of a microcomputer, and a microprocessor unit MPU therein controlls the motor M and the clutches C1–C4 according to a program stored in a memory in the microcomputer. Lines L1, L2, L3, and L4 in FIG. 3 schematically show that a gear or a belt connects the clutch C1, C2, C3, or C4 and the roller 27, 28*a*, 30 or the drum 11**, respectively.

Referring to FIGS. 2, 3, 4, and 5, a method of controlling the feed of a paper sheet to the image-forming area 31 from the cassette box positioned under the drum 11 and the transfer charger 13, is explained as follows.

In step 110, the main motor M starts to rotate, and in step 112, a warm-up time t1 is allowed to pass, then in step 114, the pick-up roller 27 starts to rotate, and in step 116, a predetermined time t2+t3 is allowed to pass. It takes the time t2 that a paper sheet is fed from the cassette box to the pair of rollers **28*a* and 28*b*, which are not rotating, by the pick-up roller 27. The pick-up roller 27 continues to rotate during the time t3 after the sheet comes into contact with the rollers 28*a* and 28*b* so that a bend of the sheet occurs while a front edge line of the sheet contacts with the rollers 28*a* and 28*b*. After the time t3, the rollers 28*a* and 28*b* start to rotate to feed the sheet in such a state that the sheet has the front edge line thereof parallel with the rollers 28*a* and 28*b***, that is, a skew of the sheet is corrected in a first correction step.

In step 118, rotation of the pick-up roller 27 is stopped and rotation of the feed roller **28*a* is started to feed the sheet along the feed path 29. In step 120, the arrival of the sheet at a predetermined position in the path 29 is detected by the sensor 44, and in step 122, a time t4+t5 is allowed to pass after the detection of the sheet by the sensor 44. It takes the time t4 that the sheet is fed to the pair of rollers 28*a* and 28*b* after detected by the sensor 44. The sheet being fed toward the image-forming area 31 by the pair of rollers 28*a* and 28*b* is brought into contact with the pair of rollers 30 and 47, which are not rotating, after the time t4 has passed. The rollers 28*a* and 28*b* continue to rotate during the time t5 after the sheet is brought into contact with the rollers 30 and 47**, and thus a skew of the sheet is fully corrected, as a second correction step.

In step 124, rotation of the rollers **28*a* and 28*b* is stopped, and in step 126, the controller 100 waits for a signal commanding a start of forming a latent image on the drum 11, from another unit not shown. In step 128, forming of a latent image is started, and in step 132, a rotation of the two pairs of rollers 30 and 47; 28*a* and 28*b* is started after a predetermined time t6 has passed in step 130 during which time t6 the drum 11 rotates, from the position where the latent image is formed, to the position where a transfer of the toner image on the drum 11 to the sheet is started, to feed the sheet to the image-forming area 31, without a skew of the sheet. In this embodiment, a rotation of the drum 11 is started when a form of the latent image is started at receiving the signal, and thus, the rollers 30, 47, 28*a*, and 28*b* start to rotate synchronously with the rotation of the drum 11. However, the drum 11 may have been rotated since the motor M started to rotate in step 110. In such a case, the rollers 30, 47, 28***a*, and 28*b* start to rotate synchronously with the form of the latent image.

The remaining step 134 designates the process of forming the image on the sheet, discharge to the tray 38, and so on.

Figure 1A:
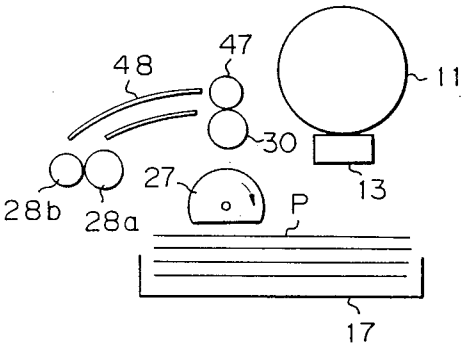
FIGS. 1*a*, 1*b*, 1*c*, and 1*d* are schematic views showing the principle of a method of separately feeding paper sheets according to the present invention.
Figure 1B:
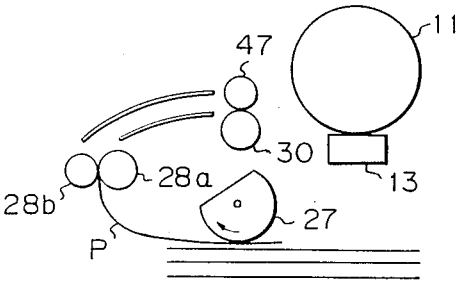
Figure 1C:
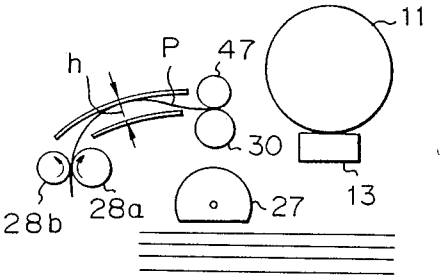
Figure 1D:
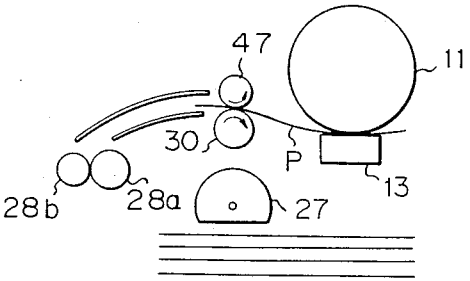
Figure 5:
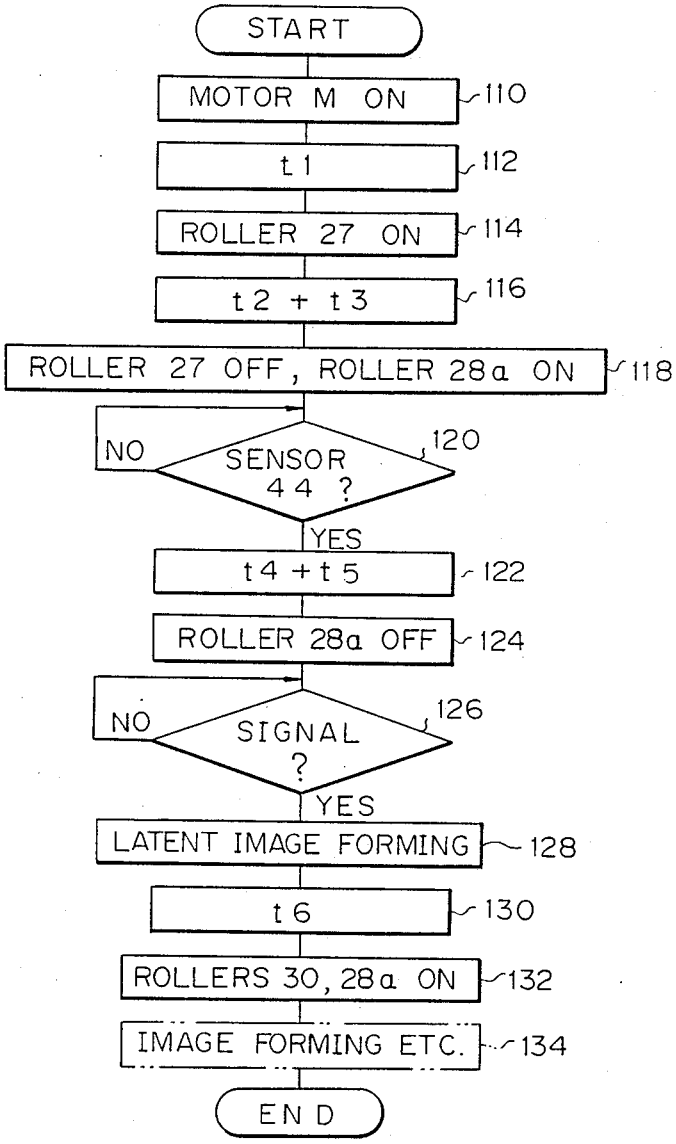
FIG. 5 is a flow chart for explaining the control steps according to the present invention.

FIGS. 1*a*, 1*b*, 1*c*, and 1*d* show stages of the feeding of the paper sheet toward the image-forming area, i.e., correspond to step 114, step 116, step 122, and step 134, of FIG. 5, respectively. As shown in FIG. 1*c*, the paper sheet P is bent when a skew thereof is corrected by the rotation of the pair of rollers 28*a* and 28*b*. In the prior art, the height dimension h enabling the sheet P to deform must be large because the correction of a skew thereof is effected in only one space between two pairs of rollers 30 and 47 and 28*a* and 28*b*. In the present invention, however, the height dimension h can be set to a small value because a skew of the sheet P is corrected in two or more spaces such as a space between a pair of rollers 28*a* and 28*b* and a pick-up roller 27, and a space between two pairs of rollers 30 and 47 and 28*a* and 28*b*, so that a compact apparatus can be provided. The compactness of the apparatus is further realized because the cassette box 17 is disposed under the photoconductive drum 11 and the transfer charger 13. Note, the path for feeding the sheet P to the image-forming area 31 between the drum 11 and the transfer charger 13, must be curved with a large curvature, and thus a skew of the sheet is generated. Therefore, the correction process of a skew of the sheet according to the present invention enables a correction of a skew of the sheet in such a compact apparatus.

In the above embodiments, the correction of the skew is effected twice, but if necessary, more than two skew corrections can be carried out by providing more than two pairs of rollers between the image-forming area 31 and the cassette box 17.

Figure 6:
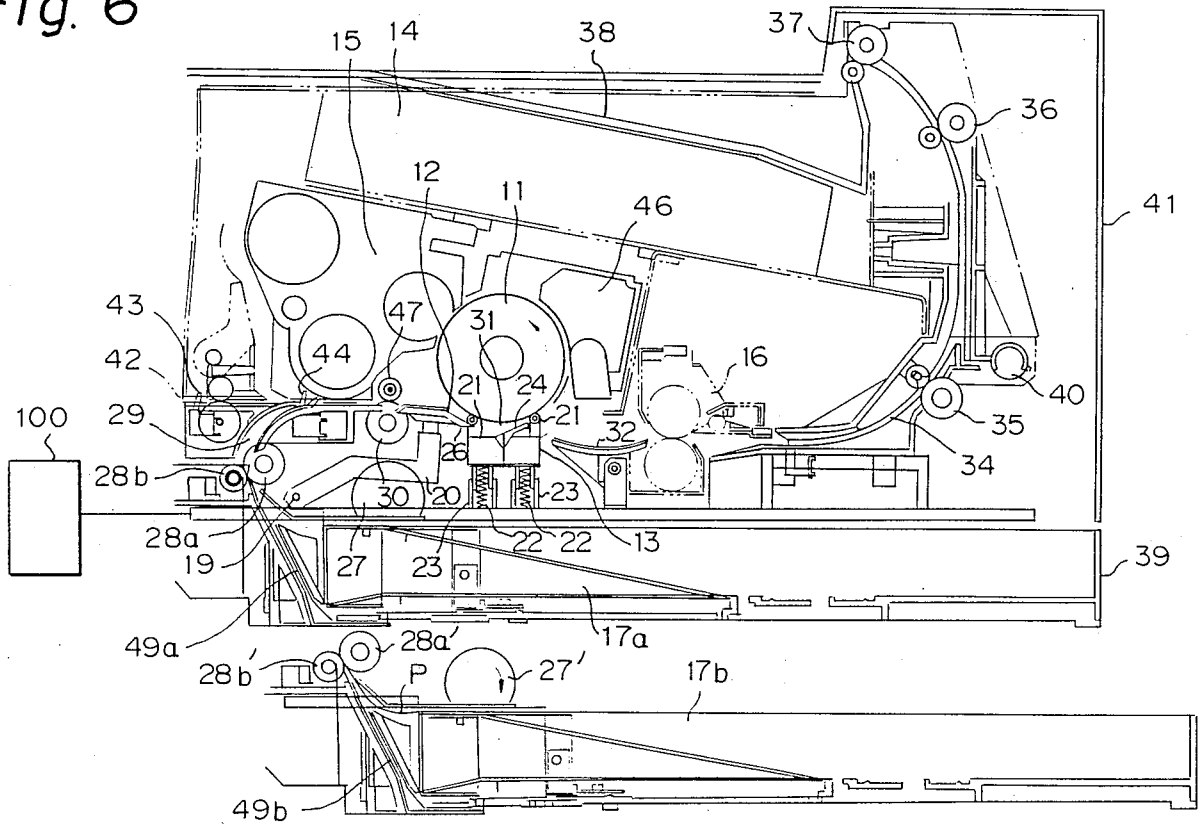
FIG. 6 is another embodiment showing a cross sectional view of an electronics image-forming apparatus according to the present invention.
Figure 7:
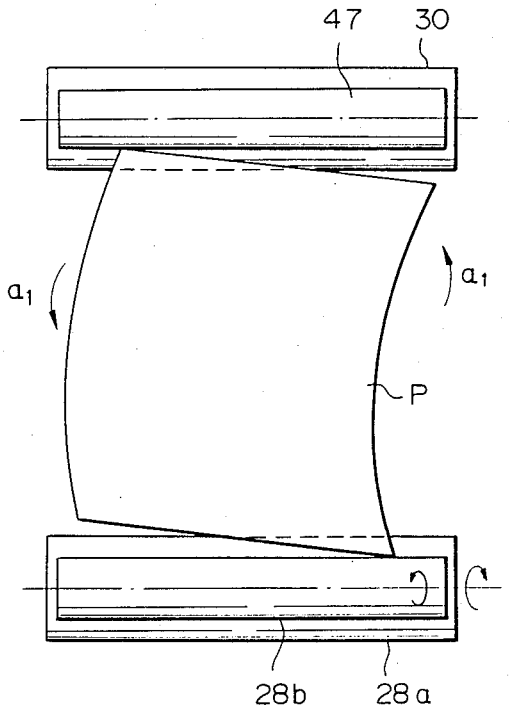
FIG. 7 is a partial plan view of an image-forming apparatus in the prior art for explaining a correction of a skew of a paper sheet.

Referring now to FIG. 6, another embodiment having multistage cassette boxes according to the present invention is explained. Two cassette boxes 17*a* and 17*b* are disposed in two stages under the drum 11 and the transfer charger 13, and pick-up roller 27 and a pair of feed rollers 28*a* and 28*b* (or 28*a*, and 28*b*,) are mounted for each cassette box 17*a* or 17*b*, and a path 49*a* or 49*b* for passing a paper sheet fed from a lower cassette box is provided in a front portion of each cassette box.

When a paper sheet P is fed from the lower cassette box 17*b*, the pick-up roller 27, at the lower position rotates to feed the sheet P to the pair of rollers 28*a*, and 28*b*', while not rotating, so that a front end of the sheet P comes into contact with the pair of rollers 28*a*, and 28*b*', and a skew of the sheet P is corrected as a first correction step. After a predetermined time, the rollers 28*a* ' and 28*b* ' start to rotate to feed the sheet P to the pair of rollers 28*a* and 28*b*, which are not rotating, at the upper position through the path 49*a* so that the front end of the sheet P comes into contact with the pair of rollers 28*a* and 28*b*, and a skew of the sheet P is corrected as the second correction step. Then, the sheet P is fed to the pair of rollers 30 and 47, which are not rotating, so that a skew of the sheet P is corrected as the final correction step. Even when more than two cassette boxes are provided, the correction process for a skew of a paper sheet is similar to the above-mentioned process.

From the above description of the preferred embodiments of the present invention it will be understood that, according to the present invention, a correction of a skew of a paper sheet is effected at least twice, so that the skew is fully corrected even when the skew is large, and a space for the correction may be made small to thus provide a compact apparatus.

Furthermore, when a cassette box able to be used for several sizes of paper sheets is adopted, a large size sheet is housed in the cassette box in a position deviated from a pick-up roller, so that a skew of the large sheet is generated. In such a case, the skew can be fully corrected by several corrections according to the present invention.

When a plurality of cassette boxes are mounted in a multistage state, a length of each path for feeding a paper sheet from each cassette box differs, but a control method for feeding each sheet may be simple and have no relation to each path length, because each sheet is fed after the sheet comes into contact with a pair of rollers corresponding to the cassette box housing the sheet.

We claim:

1. A method of separately feeding a print medium sheet from a pile of print medium sheets to an image-forming area for forming an image on the sheet, characterized int hat at least two pairs of feed rollers are provided in a path of the sheet between said pile and said image-forming area, that a sheet is fed by a pick-up roller for picking up a sheet from said pile to a pair of feed rollers which are not rotating, and after a predetermined time has passed while said sheet remains in contact with said pair of feed rollers, said pair of feed rollers start to rotate to feed said sheet to a second pair of feed rollers, which are not rotating, and after a predetermined time has passed while said paper sheet remains in contact with said second pair of feed rollers, said second pair of feed rollers start to rotate to feed said sheet.

2. A method of separately feeding a print medium sheet according to claim 1, wherein said pile of print medium sheets is a pile of paper sheets and said pile of paper sheets are stored in a cassette box.

3. An apparatus for separately feeding a print medium sheet, having a pick-up roller for picking up a separate print medium sheet from a pile of print medium sheets, comprising:

a plurality of pairs of feed rollers disposed at predetermined positions along a path for separately feeding a sheet from said pile to an image-forming area for forming an image on the sheet; and, a control means for controlling one pair of feed rollers of said plurality of pairs of feed rollers so that said one pair of feed rollers are held stationary until a second sheet arrives at said one pair of feed rollers and a predetermined time has passed after the arrival from a time at which a first sheet has passed through said one pair of feed rollers, and controlling a second pair of feed rollers of said plurality of pairs of feed rollers so that said second pair of feed rollers are held stationary until said second sheet arrives at said second pair of feed rollers and a predetermined time has passed after the arrival from a time at which said first sheet has passed through said second pair of feed rollers.

4. An apparatus for separately feeding a print medium sheet according to claim 3 wherein said pile of print medium sheets is a pile of paper sheets and said pile of paper sheets are stored in a cassette box.

5. An apparatus for separately feeding a print medium sheet according to claim 4, wherein a sensor for detecting a passage of each sheet is provided at a predetermined position between every two pairs of feed rollers.

6. An apparatus for separately feeding a print medium sheet according to claim 4, wherein said cassette box is mounted at one of an upper and lower position relative to said image-forming area, and said path for the sheet has a large curvature.

7. An apparatus for separately feeding a print medium sheet according to claim 4, wherein said print medium sheets are provided in a plurality of cassette boxes, said cassette boxes are mounted to said apparatus with each cassette being stacked relative to another cassette, and a feeding path for the sheets fed from each cassette box is provided at a front end of each of said cassette boxes.

* * * * *